US011243499B2

(12) United States Patent
Lagorgette et al.

(10) Patent No.: US 11,243,499 B2
(45) Date of Patent: Feb. 8, 2022

(54) METHOD FOR SETTING A QUARTZ WATCH

(71) Applicant: ETA SA Manufacture Horlogere Suisse, Grenchen (CH)

(72) Inventors: Pascal Lagorgette, Bienne (CH); Raphael Balmer, Vicques (CH); Jean-Bernard Peters, Pieterlen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 532 days.

(21) Appl. No.: 15/919,549

(22) Filed: Mar. 13, 2018

(65) Prior Publication Data

US 2018/0267478 A1 Sep. 20, 2018

(30) Foreign Application Priority Data

Mar. 20, 2017 (EP) ..... 17161866

(51) Int. Cl.
*G04C 9/00* (2006.01)
*G04B 19/24* (2006.01)

(52) U.S. Cl.
CPC ..... *G04C 9/00* (2013.01); *G04B 19/24* (2013.01)

(58) Field of Classification Search
CPC ..... G04C 9/00; G04B 19/24
See application file for complete search history.

(56) References Cited

U.S. PATENT DOCUMENTS 4,211,065 A 7/1980 Schmitz et al.
5,771,399 A * 6/1998 Fishman ..... G04G 21/00 368/47
5,777,950 A * 7/1998 Helm ..... G04R 20/00 368/10

(Continued)

FOREIGN PATENT DOCUMENTS

EP 3 079 025 A1 10/2016

OTHER PUBLICATIONS

European Search Report dated Sep. 27, 2017 in European application 17161866.3, filed on Mar. 20, 2017 (with English Translation of Categories Cited).

*Primary Examiner* — Daniel P Wicklund
(74) *Attorney, Agent, or Firm* — Oblon, McClelland, Maier & Neustadt, L.L.P.

(57) ABSTRACT

The present invention relates to a method for setting a quartz watch, the watch comprising an optical sensor and a microcontroller configured to receive electrical signals generated by the optical sensor, the method being performed by way of a portable electronic appliance comprising a point light source and a microcontroller configured to control said point light source, the method comprising the following steps:

placing the optical sensor of the watch facing the point light source of the electronic appliance on the order of the microcontroller of the electronic appliance, flashing the point light source of the electronic appliance so as to form a sequence of light pulses (Continued)

corresponding to a coding of setting parameters, the sequence then being received by the optical sensor of the watch decoding the received light sequence, by way of the microcontroller of the watch, in order to recover the setting parameters on the order of the microcontroller of the watch, setting the watch according to the setting parameters.

8 Claims, 3 Drawing Sheets

(56) References Cited

U.S. PATENT DOCUMENTS

| | | | | |
|---|---|---|---|---|
| 5,835,388 | A * | 11/1998 | Helm | G04G 21/00 708/111 |
| 2003/0112708 | A1* | 6/2003 | Fujisawa | G04G 21/04 368/47 |
| 2004/0052161 | A1* | 3/2004 | Liao | G04C 9/00 368/47 |
| 2010/0246336 | A1* | 9/2010 | Luk | G04B 19/241 368/28 |
| 2014/0003200 | A1* | 1/2014 | Lamarche | G04B 5/00 368/47 |
| 2016/0266554 | A1 | 9/2016 | Ogasawara et al. | |
| 2016/0299475 | A1 | 10/2016 | Baba et al. | |
| 2017/0118639 | A1* | 4/2017 | Beale | H04W 12/06 |
| 2019/0049904 | A1* | 2/2019 | Lagorgette | G04G 5/002 |
| 2019/0121297 | A1* | 4/2019 | Buehler | G04D 7/006 |
| 2020/0019127 | A1* | 1/2020 | Klopfenstein | G04G 5/027 |

* cited by examiner

METHOD FOR SETTING A QUARTZ WATCH

This application claims priority from European Patent Application No. 17161866.3 filed on Mar. 20, 2017; the entire disclosure of which is incorporated herein by reference.

TECHNICAL FIELD

The present invention relates to the technical field of electronic watches. The invention relates more particularly to a method for setting an electronic watch.

PRIOR ART

So-called "connected" watches, able to communicate with an electronic appliance such as a smartphone, have emerged in the watchmaking sector in recent years. Such a watch may be set manually, in particular by activating pushbuttons, crowns and/or touch buttons, this being relatively inconvenient for the user or the after-sales service responsible for the setting. For example, if the watch has a perpetual calendar mechanism, setting the position of the analogue display elements of the perpetual calendar mechanism, and more generally setting the perpetual calendar mechanism, may be carried out by pulling and/or turning a crown of the watch and/or by pressing one or more pushbuttons of the watch. Thus, a type of year (for example a leap year) is selected, and the various display elements, and more generally all of the elements of the perpetual calendar mechanism, are positioned correctly. This method is not only burdensome for the user, who has to correctly recall and execute all of the setting operations one after another, but it furthermore creates risks of errors and discrepancies.

To avoid these drawbacks, it is nowadays possible to set an electronic watch automatically, by equipping it with devices that support Bluetooth technology or a near-field communication technology. However, these devices are somewhat difficult to implement and require the incorporation of specific communication means both on the electronic appliance and on the watch, in particular antennae. They also have to be certified, thereby generating an additional extra cost.

SUMMARY OF THE INVENTION

The aim of the present invention is to mitigate these drawbacks by proposing a method for setting a perpetual calendar mechanism of a quartz watch, which method is simple and reliable and does not require the incorporation of communication means that are difficult to implement and expensive.

To this end, the invention relates to a method for setting a quartz watch, the watch comprising an optical sensor and a microcontroller configured to receive electrical signals generated by the optical sensor, the watch also comprising a point light source controlled by the microcontroller of the watch, the method being performed by way of a portable electronic appliance comprising a point light source and a microcontroller configured to control said point light source, the electronic appliance also comprising an optical sensor designed to supply electrical signals to the microcontroller of the electronic appliance, the method comprising the following steps:

placing the optical sensor of the watch facing the point light source of the electronic appliance on the order of the microcontroller of the electronic appliance, flashing the point light source of the electronic appliance so as to form a sequence of light pulses corresponding to a coding of setting parameters, the sequence then being received by the optical sensor of the watch decoding the received light sequence, by way of the microcontroller of the watch, in order to recover the setting parameter on the order of the microcontroller of the watch, setting the watch according to the setting parameters placing the optical sensor of the electronic appliance facing the point light source of the watch on the order of the microcontroller of the watch, flashing the point light source of the watch so as to form a sequence of light pulses corresponding to a coding of state data characteristic of a current setting of the watch, the light sequence then being received by the optical sensor of the electronic appliance decoding the received light sequence, by way of the microcontroller of the electronic appliance, in order to recover the state data comparing the state data with the setting parameters.

The term "setting parameter" is understood to mean any parameter that makes it possible to at least partially set the watch. This may involve for example information regarding a time zone, a country code, an alarm, a geographical position, a date, a tide, a solar or lunar phase, a UTC time, etc.

The term "point light source" is understood to mean a light source the size of which is negligible and that can be considered as a point. Such a point light source is for example a light-emitting diode.

The term "facing" is understood to mean that the point light source and the optical sensor are positioned with respect to one another and at a distance such that the optical sensor is able to directly receive and capture the light signals emitted by the point light source.

The term "portable electronic appliance" is understood to mean an electronic appliance, also called user terminal, capable of being carried and transported by a user and of operating when it is being transported. This is the case for example for a smartphone. Of course, appliances needing a mains power supply, for example desktop computers, are excluded from this definition. Assemblies of appliances, for example a portable computer to which a sensor is connected via a wireless or wired link, are also excluded from this definition.

The electronic appliance is used to transmit setting parameters to the watch. The transmission is performed by way of optical coding or modulation, the modulation being created by the flashing of the point light source of the electronic appliance. Said point light source has two states: on or off. During transmission, the optical sensor of the watch therefore receives a sequence of light pulses. Through a decoding operation, the microcontroller of the watch is capable of recovering the setting parameters. For example, a light pulse represents a bit with the value '1', and an absence of a light pulse represents a bit with the value '0'. The setting parameters, once they have been recovered, then make it possible to correctly set the watch.

This method has the advantage of being able to be implemented mostly automatically, without the user having to perform complex setting via crowns, pushbuttons or touch buttons for example. Of course, the method has to be initiated, this being able to be performed either manually by pressing a pushbutton or automatically, for example via a system that is in standby by default and that wakes upon receipt of a certain light sequence.

This method also has the advantage of requiring very little hardware: a portable appliance of smartphone type with a suitable mobile application is sufficient to implement it. The method does not require the use of dedicated hardware such as a sensor to be connected to a computer, nor does it require the use of bulky hardware. Anyone (for example a watchmaker) who has a smartphone having a suitable application may implement the method.

Lastly, this method has the advantage of not having to incorporate communication antennae (which are expensive, bulky and sometimes incompatible with metal outer casings) on the watch or the electronic appliance, the optical communication system between the watch and the electronic appliance being formed only of a point light source of light-emitting diode type and of an optical sensor of phototransistor type.

In one embodiment, the watch includes a perpetual calendar mechanism. Such a watch has, as setting mechanism, a quartz oscillator that actuates one or more step motors that turn the time display hands and analogue display elements of the perpetual calendar mechanism. These display elements make it possible to indicate the date, the day, the month, and possibly the lunar phase, by automatically taking account of the various lengths of months and leap years. Such a display element is for example a hand that makes it possible to point to an indication of the date, day, month or lunar phase inscribed on the face of the watch, or else a disc on which indications of the date, day, month or lunar phases are inscribed, one of these indications facing an aperture in the face. In this case, the method may be intended to set said mechanism. The invention then consists of a method for setting a perpetual calendar mechanism of a quartz watch, the watch comprising means for positioning elements of said mechanism, an optical sensor, and a microcontroller configured to control said positioning means and receive electrical signals generated by the optical sensor, the method being performed by way of a portable electronic appliance comprising a point light source and a microcontroller configured to control said point light source, the method comprising the following steps:

placing the optical sensor of the watch facing the point light source of the electronic appliance on the order of the microcontroller of the electronic appliance, flashing the point light source of the electronic appliance so as to form a sequence of light pulses corresponding to a coding of setting parameters for the perpetual calendar mechanism, the sequence then being received by the optical sensor of the watch decoding the received light sequence, by way of the microcontroller of the watch, in order to recover the setting parameters on the order of the microcontroller of the watch, actuating the means for positioning the elements of the perpetual calendar mechanism so as to position said elements in a position corresponding to said setting parameters (this is the setting step).

The term "setting parameters for the perpetual calendar mechanism" is understood to mean information relating to the current date, day, month and year (and possibly to the current lunar phase when the perpetual calendar mechanism comprises an element for displaying the lunar phase, these data then being for example a geographical position, a hemisphere, a country code, etc.), this information being sufficient to correctly set the perpetual calendar mechanism of the watch, in particular the position of the display elements of this mechanism.

Moreover, the watch comprises time display hands and means for rotating said hands, the electronic appliance comprising a camera and optical recognition software that are controlled by the microcontroller of the electronic appliance, the method comprising the following step, performed following the setting step: on the order of the microcontroller of the watch, actuating the means for rotating the time display hands so as to place said hands in a position for coding an item of state data characteristic of a current setting of the watch.

The term "time display hands" is understood to mean the hour, minute and second hands.

The term "item of state data" is understood to mean an item of data that makes it possible to represent an at least partial setting state of the watch. This may involve for example a time zone, a country code, an alarm, a geographical position, a date, a tide, a solar or lunar phase, a UTC time, etc. that is set on the watch. If the method is intended to set said perpetual calendar mechanism, the item of state data may relate to the current date, day, month or year (or even to the current lunar phase when the perpetual calendar mechanism comprises an element for displaying the lunar phase, for example an item of data relating to the geographical position, to the hemisphere, to the country code, etc.), said item of state data representing a current setting state of the perpetual calendar mechanism, for example a position of a display element of said mechanism.

The method according to the invention may comprise one, or a technically feasible combination, of the following features.

In one nonlimiting embodiment, the optical sensor of the watch is situated on the movement of the watch on the bottom side, the method comprising the following step, performed before the step of positioning the optical sensor of the watch facing the point light source of the electronic appliance:

removing the bottom of the watch casing so as to expose the optical sensor of the watch.

In one nonlimiting embodiment, the method comprises the following steps, performed following the step of actuating the means for rotating the time display hands:

placing the face of the watch and the camera of the electronic appliance facing one another detecting the position of the time display hands by way of the camera and the optical recognition software of the electronic appliance converting the detected position of the time display hands in order to recover the item of state data.

In one nonlimiting embodiment, the electronic appliance comprises a screen that makes it possible to display the images captured by the camera of the electronic appliance, the method comprising the following step, performed following the step of converting the detected position of the time display hands:

superimposing a virtual object illustrating the item of state data onto the face displayed on the screen of the electronic appliance.

In one nonlimiting embodiment, the method comprises the following final step:

comparing the item of state data with one of the setting parameters.

In one nonlimiting embodiment, the watch includes a perpetual calendar mechanism and means for positioning elements of said mechanism, the microcontroller of the watch being configured to control said positioning means, the setting step comprising actuation of the means for positioning the elements of the perpetual calendar mechanism so as to position said elements in a position corresponding to the setting parameters.

In one nonlimiting embodiment, the optical sensor of the watch is a phototransistor.

In one nonlimiting embodiment, the electronic appliance is a smartphone.

BRIEF DESCRIPTION OF THE FIGURES

The aims, advantages and features of the invention will become more clearly apparent in the following detailed description of at least one embodiment of the invention, given solely by way of nonlimiting example and illustrated by the appended drawings, in which.

DETAILED DESCRIPTION OF ONE EMBODIMENT

Figure 1:
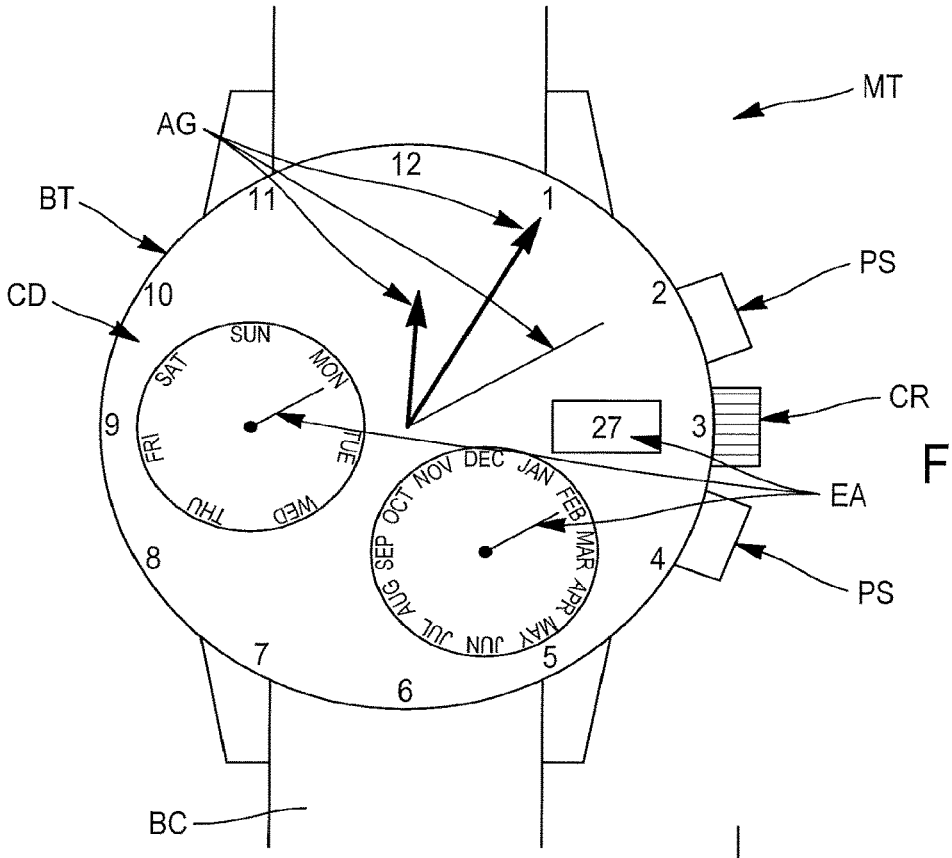
FIG. 1 schematically depicts a watch, viewed from the face side, that makes it possible to implement, with a portable electronic appliance, the method according to one embodiment of the invention FIG. 2 schematically depicts electronic elements of the watch of FIG. 1 seen from the bottom side with the bottom removed, and also the connections of said elements FIG. 3 schematically depicts a front face of the portable electronic appliance FIG. 4 schematically depicts steps of the method.
Figure 2:
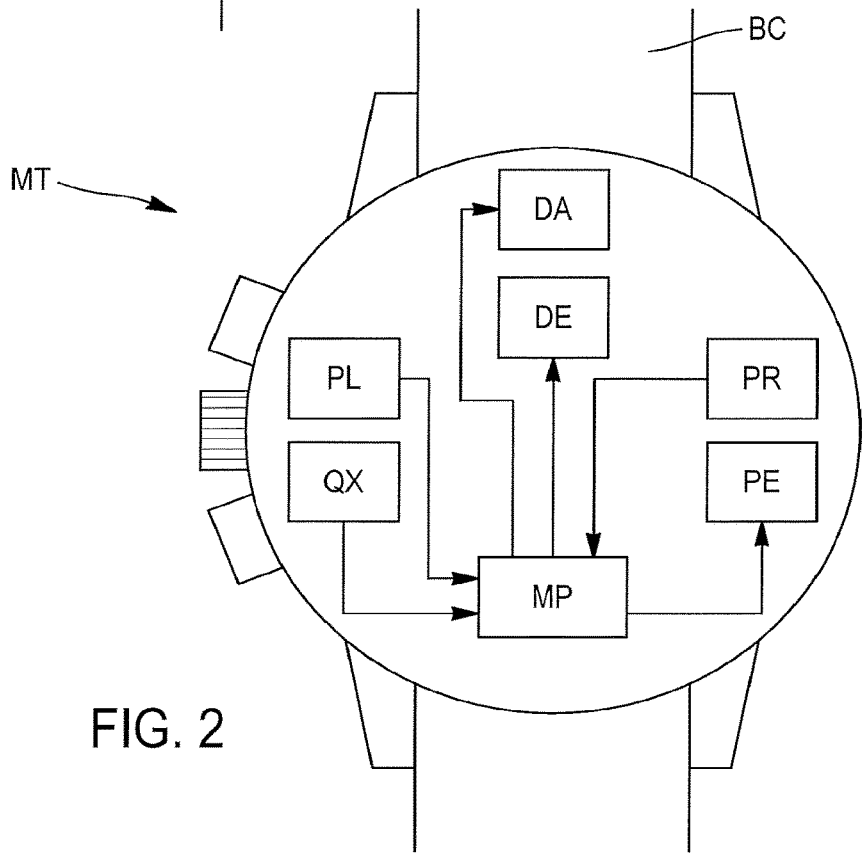
Figure 3:
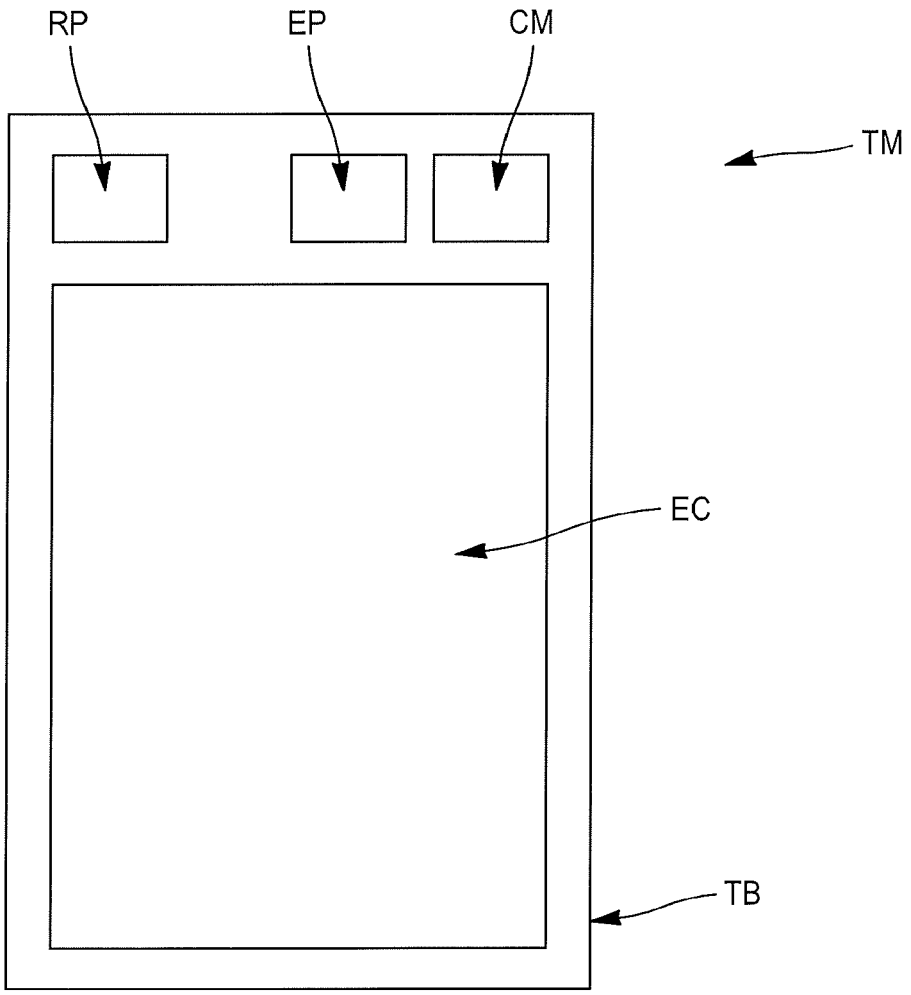
Figure 4:
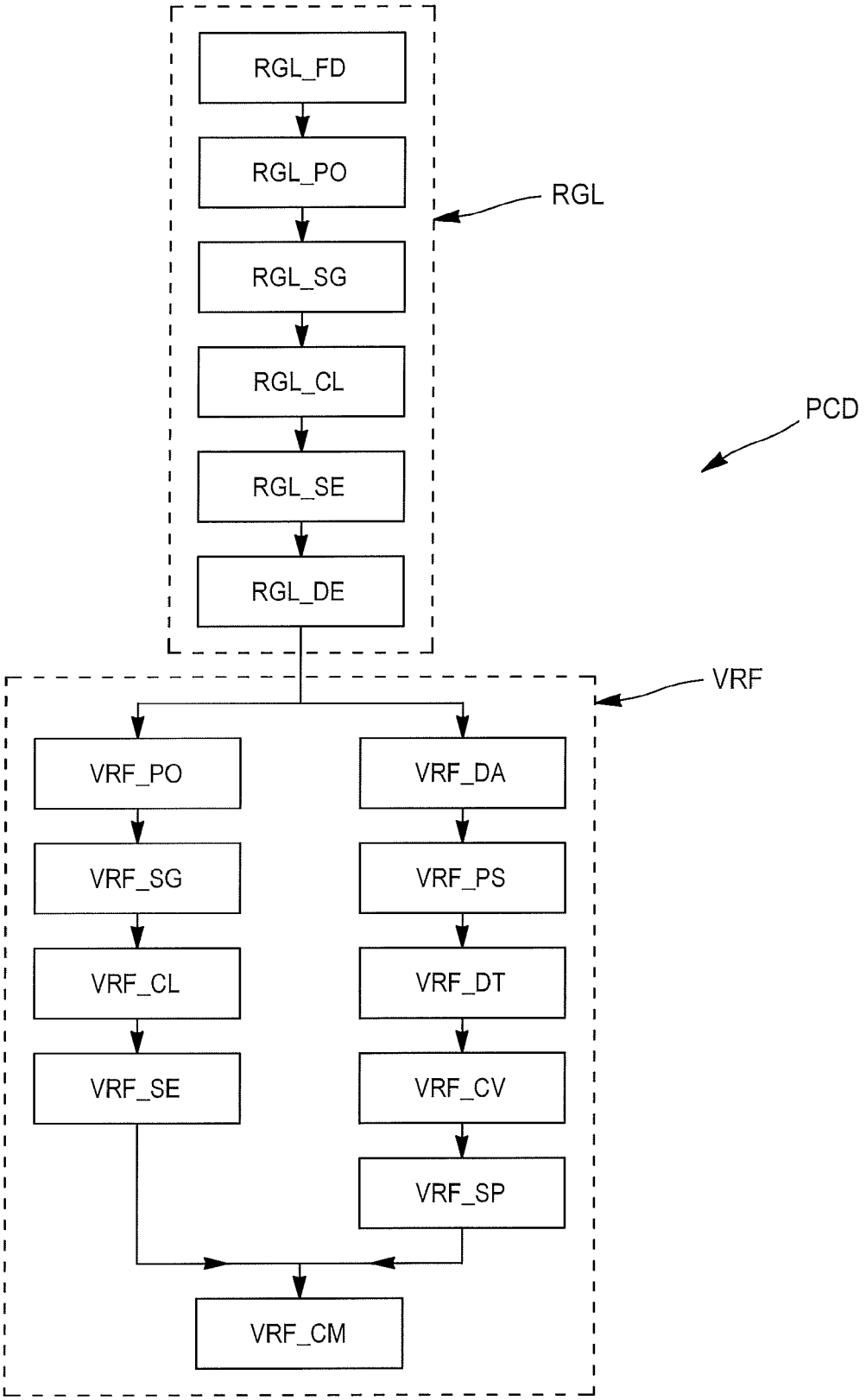

FIGS. 1, 2 and 3 show a watch MT and a portable electronic appliance TM that make it possible to implement the method PCD according to one embodiment of the invention.

The watch MT comprises a casing BT, a face CD and a bottom for closing said casing BT on both sides, and a strap BC connected to the casing BT. The watch MT has an analogue display, and it therefore comprises three time display hands AG for indicating the hour, the minute and the second. The watch MT also comprises a perpetual calendar mechanism. The perpetual calendar mechanism comprises a set of elements, namely elements EA for displaying the date, the day and the month (among the elements of the perpetual calendar mechanism, only the display elements EA are shown in the figures). The display elements EA are in this case two hands for indicating the day and the month, and a disc for indicating the date. In one embodiment, the perpetual calendar mechanism also comprises an element for displaying the lunar phase, for example in the form of a depiction of the Moon that is able to move in a portion of the face.

The casing BT contains a microcontroller MP, a power supply unit PL, such as an accumulator or a battery, for powering the microcontroller MP, and a quartz QX for supplying a time base to the microcontroller MP. The microcontroller MP is used to control means DE for positioning the elements of the perpetual calendar mechanism, in particular the display elements EA. The means DE for positioning the elements of the perpetual calendar mechanism advantageously comprise one or more step motors. The microcontroller MP is also connected to control means that may be a crown CR, pushbuttons PS or touchpads, and that are able to be actuated directly by the wearer of the watch MT. The watch MT furthermore includes an optical sensor PR positioned on the movement of the watch MT on the bottom side and itself linked to the microcontroller MP. The optical sensor PR of the watch MT is capable of detecting a sequence of light pulses and of transforming this sequence into an electrical signal. The optical sensor PR is for example a phototransistor or a photodiode.

The portable electronic appliance TM is for example a smartphone or a touchscreen tablet. The electronic appliance TM comprises a casing in which an electronic circuit is arranged. This electronic circuit includes a microcontroller and a point light source EP, both supplied with power by a battery. The point light source EP of the electronic appliance TM is capable of emitting a sequence of light pulses on the basis of an electrical signal. The point light source EP of the electronic appliance TM is for example a light-emitting diode that is otherwise used as a camera flash.

The invention relates to a method PCD that makes it possible to set the perpetual calendar mechanism of the watch MT, in particular the position of the display elements EA of said mechanism. The method PCD first of all includes a phase RGL of setting the elements of the perpetual calendar mechanism per se, and then, in one embodiment, a phase VRF of verifying (or confirming) that the current setting of the perpetual calendar mechanism is correct.

The setting phase RGL includes a first step RGL_FD consisting in removing the bottom of the watch MT casing BT so as to expose the optical sensor PR of the watch MT. Specifically, the bottom of the casing of a quartz watch is generally removable so as to be able to change the power supply unit PL of the watch MT. However, this first step is not mandatory: specifically, in some embodiments, the optical sensor PR of the watch MT is not located on the movement on the bottom side. For example, the optical sensor PR may be situated underneath the face CD, said face having an aperture or a transparent portion or being made of a partially transparent material. As an alternative, the optical sensor PR may be arranged on the edge of the watch MT casing BT, or else on a transparent portion of the bottom of the watch MT.

A second setting step RGL_PO then consists in placing the optical sensor PR of the watch MT facing the point light source EP of the electronic appliance TM. The term "facing" is understood to mean that the point light source EP and the optical sensor PR are positioned with respect to one another and at a distance such that the optical sensor PR is able to directly receive and capture the light signals emitted by the point light source EP.

A third setting step RGL_SG consists in sending an electronic control signal from the microcontroller to the point light source EP of the electronic appliance TM. The control signal is such that it corresponds to a coding of setting parameters for the perpetual calendar mechanism, that is to say to a coding of a set of data relating to the current date, day, month and year (and also the lunar phase where applicable). These setting parameters are for example recovered regularly or on request via an Internet network from the electronic appliance TM. It will be noted that, to perform this coding, it is advantageous to use a dedicated application installed on the electronic appliance TM. If the electronic appliance TM is a smartphone or a touchscreen tablet, this application is advantageously capable of generating the coding on the basis of the date, day, month, year and geographical position data given by the electronic appliance TM.

A fourth setting step RGL_CL consists in turning on and turning off the point light source EP of the electronic appliance TM in a sequence of light pulses corresponding to the received control signal. The control signal is binary, such that it is able to be interpreted by the point light source EP as a succession of instructions to turn on or turn off. For example, a low state or "0" corresponds to an instruction to turn off the point light source EP or to leave it turned off, and a high state or "1" corresponds to an instruction to turn on the point light source EP or to leave it turned on, or vice versa. Given that the optical sensor PR of the watch MT is positioned facing the point light source EP of the electronic appliance TM, the optical sensor PR of the watch MT captures the sequence of light pulses emitted by the point light source EP of the electronic appliance TM and converts it into a binary electrical signal.

A fifth setting step RGL_SE consists in transmitting this electrical signal to the microcontroller of the watch MT, which then decodes it so as to recover the current perpetual calendar.

A sixth setting step RGL_DO consists, on the order of the microcontroller of the watch MT, in actuating the means DE for positioning the elements of the perpetual calendar mechanism so as to place said elements in a position corresponding to the setting parameters obtained by the decoding.

The verification phase VRF may be carried out in several different ways. According to a first way of verifying the settings, the watch MT includes a point light source PE linked to the microcontroller MP of the watch MT, while the electronic appliance TM includes an optical sensor RP linked to the microcontroller of the electronic appliance TM. The optical sensor RP of the electronic appliance TM is capable of detecting a sequence of light pulses and of transforming said sequence into an electrical signal. The optical sensor RP is for example a phototransistor or a photodiode. By contrast, the point light source PE of the watch MT is capable of emitting a sequence of light pulses on the basis of an electrical signal. The point light source PE of the watch MT is for example a light-emitting diode.

A first verification step VRF_PO then consists in placing the point light source PE of the watch MT facing the optical sensor RP of the electronic appliance TM. The term "facing" is understood to mean that the point light source PE and the optical sensor RP are positioned with respect to one another and at a distance such that the optical sensor RP is able to directly receive and capture the light signals emitted by the point light source PE. In the embodiment shown, the point light source PE of the watch MT is positioned on the movement of the watch MT on the bottom side, but in other embodiments the point light source PE of the watch MT is situated at another location. For example, the point light source PE of the watch MT may be situated underneath the face CD, said face having an aperture or a transparent portion or being made of a partially transparent material. As an alternative, the point light source PE of the watch MT may be arranged at the edge of the watch MT casing BT.

A second verification step VRF_SG consists in sending an electronic control signal from the microcontroller to the point light source PE of the watch MT. The control signal is such that it corresponds to a coding of state data characteristic of the current setting of the perpetual calendar mechanism. The state data relate to the current date, day, month and year (and possibly to the current lunar phase when the perpetual calendar mechanism comprises an element for displaying the lunar phase, for example data relating to the geographical position, a hemisphere, a country code, etc.). These state data are sufficient to show a current setting state of the perpetual calendar mechanism, in particular the position of the display elements of said mechanism.

A third verification step VRF_CL consists in turning on and turning off the point light source PE of the watch MT in a sequence corresponding to the received control signal. The coding is binary, such that it is able to be interpreted by the point light source PE as a succession of instructions to turn on or turn off. For example, a low state or "0" corresponds to an instruction to turn off the point light source PE or to leave it turned off, and a high state or "1" corresponds to an instruction to turn on the point light source PE or to leave it turned on, or vice versa. Given that the optical sensor RP of the electronic appliance TM is positioned facing the point light source PE of the watch MT, the optical sensor RP of the electronic appliance TM captures the sequence of light pulses emitted by the point light source PE of the watch MT and converts it into a binary electrical signal.

A fourth verification step VRF_SE consists in transmitting this electrical signal to the microcontroller of the electronic appliance TM, which decodes it so as to recover the state data.

A fifth verification step VRF_CM consists in comparing the state data with the setting parameters in order to verify that the setting of the perpetual calendar mechanism is correct.

According to a second way of verifying the settings, the watch MT may or may not include a point light source PE and the electronic appliance TM may or may not include an optical sensor RP. By contrast, the electronic appliance TM must include a camera CM, a screen EC and optical recognition software.

A first verification step CRF_DA then consists, on the order of the microcontroller of the watch MT, in actuating the means DA for rotating the time display hands AG so as to place said hands AG in a position characteristic of an item of state data of the current setting of the perpetual calendar mechanism. For example, two hands indicate the type of item of state data, and the third hand indicates the value of this item of data. In this case, the type "date" is for example identified by the hour hand pointing to 1 and the minute hand pointing to 2, and the position of the second hand indicates the value of the date.

A second verification step VRF_PS consists in placing the face CD of the watch MT and the camera CM of the electronic appliance TM facing one another. The term "facing" is understood to mean that the face CD and the camera CM are positioned with respect to one another and at a distance such that the time display hands are in the field of view of the camera.

A third verification step VRF_DT consists in detecting the position of the time display hands AG by way of the camera CM and the optical recognition software. This step consists in taking a photograph of the time display hands AG, this photograph then being analysed by the optical recognition software. The software advantageously compares the position of the time display hands AG with fixed reference points on the face CD (for example the indexes of the watch) so as to determine the indicated time.

A fourth verification step VRF_CV consists in decoding the detected position of the time display hands in order to recover the coded item of state data.

Steps 1 to 4 are then reiterated for a different item of state data until all of the state data necessary for determining whether the perpetual calendar mechanism is set correctly have been transmitted from the watch MT to the electronic appliance TM.

A fifth verification step VRF_SP consists in superimposing one or more virtual objects representative of the state data obtained through the decoding onto the face shown on the screen of the electronic appliance TM (the face being filmed or photographed by the camera, for example), in accordance with the principle of augmented reality. For example, if the "date" item of state data has been transmitted and decoded, a virtual object illustrating the date is superimposed onto the face.

It will be noted that the verification phase VRF is optional. It will also be noted that the verification phase VRF may be carried out at any time: a user may thus at any time ask the watch MT to set the date, the day and the month, and display this information on the electronic appliance TM (for example a smartphone). No communication system is necessary between the watch MT and the electronic appliance TM for supplying this verification information. It will be noted, lastly, that the electronic appliance used in the verification phase VRF could very well be different from the electronic appliance TM used in the setting phase RGL.

It will be understood that numerous modifications and/or improvements and/or combinations that are obvious to those skilled in the art may be made to the various embodiments of the invention outlined above without departing from the scope of the invention defined by the appended claims. For example, in the second way of verifying the settings, steps 2 to 5 could be omitted, with the user himself translating the position of the time display hands into a useful item of data.

In addition, even though the description details the setting and the verification of the setting of a perpetual calendar mechanism, other settings could alternatively be carried out, for example setting a time zone, a time, tides, etc. This information that is set is moreover not necessarily displayed in an analogue fashion on the watch (by hands or discs in particular), but may be displayed digitally on the face: the setting step therefore does not necessarily include activation of means for moving analogue display elements.

What is claimed is:

1. A method for setting a quartz watch, the watch including an optical sensor and a microcontroller configured to receive electrical signals generated by the optical sensor, the watch also including a point light source controlled by the microcontroller of the watch producing a sequence of light pulses, the method being performed by the way of a portable electronic appliance including a point light source, also producing a sequence of light pulses and a microcontroller configured to control said point light source, the electronic appliance also including an optical sensor designed to supply electrical signals of the microcontroller of the electronic appliance, the method comprising:

placing the optical sensor of the watch facing the point light source of the electronic appliance;

on the order of the microcontroller of the electronic appliance, flashing the point light source of the electronic appliance to form a sequence of light pulses corresponding to a coding of setting parameters, the sequence then being received by the optical sensor of the watch;

decoding the received sequence of light pulses, by way of the microcontroller of the watch, in order to recover the setting parameters;

on the order of the microcontroller of the watch, setting the watch according to the setting parameters;

placing the optical sensor of the electronic appliance facing the point light source of the watch;

on the order of the microcontroller of the watch, flashing the point light source of the watch to form a sequence of light pulses corresponding to a coding of state data characteristic of a current setting of the watch, the sequence of light pulses then being received by the optical sensor of the electronic appliance;

decoding the received sequence of light pulses, by way of the microcontroller of the electronic appliance, in order to recover the state data; and comparing the state data with the setting parameters, wherein the watch further includes time display hands and means for rotating said hands, wherein the electronic appliance further includes a camera and optical recognition software that are controlled by the microcontroller of the electronic appliance, and wherein the method further comprises, following the setting step, on the order of the microcontroller of the watch, actuating the means for rotating the time display hands to place said hands in a position for coding an item of state data characteristic of a current setting of the watch;

placing the face of the watch and the camera of the electronic appliance facing one another;

detecting the position of the time display hands by way of the camera and the optical recognition software of the electronic appliance; and converting the detected position of the time display hands in order to recover the item of state data.

2. The setting method according to claim 1, wherein the electronic appliance further includes a screen that makes possible display of images captured by the camera of the electronic appliance, the method comprising, following the converting the detected position of the time display hands:

superimposing a virtual object illustrating the item of state data onto the face displayed on the screen of the electronic appliance.

3. The setting method according to claim 1, further comprising:

comparing the item of state data with one of the setting parameters.

4. The setting method according to claim 1, wherein the watch includes a perpetual calendar mechanism and means for positioning elements of said mechanism, the microcontroller of the watch being configured to control said means for positioning, wherein the setting further comprises actuating the means for positioning the elements of the perpetual calendar mechanism to position said elements in a position corresponding to the setting parameters.

5. The setting method according to claim 1, wherein the optical sensor of the watch is a phototransistor.

6. The setting method according to claim 1, wherein the electronic appliance is a smartphone.

7. A method for setting a quartz watch, the watch including an optical sensor and a microcontroller configured to receive electrical signals generated by the optical sensor, the watch also including a point light source controlled by the microcontroller of the watch producing a sequence of light pulses, the method being performed by the way of a portable electronic appliance including a point light source, also producing a sequence of light pulses and a microcontroller configured to control said point light source, the electronic appliance also including an optical sensor designed to supply electrical signals of the microcontroller of the electronic appliance, the method comprising:

placing the optical sensor of the watch facing the point light source of the electronic appliance;

on the order of the microcontroller of the electronic appliance, flashing the point light source of the electronic appliance to form a sequence of light pulses corresponding to a coding of setting parameters, the sequence then being received by the optical sensor of the watch;

decoding the received sequence of light pulses, by way of the microcontroller of the watch, in order to recover the setting parameters;

on the order of the microcontroller of the watch, setting the watch according to the setting parameters;

placing the optical sensor of the electronic appliance facing the point light source of the watch;

on the order of the microcontroller of the watch, flashing the point light source of the watch to form a sequence of light pulses corresponding to a coding of state data characteristic of a current setting of the watch, the sequence of light pulses then being received by the optical sensor of the electronic appliance;

decoding the received sequence of light pulses, by way of the microcontroller of the electronic appliance, in order to recover the state data; and comparing the state data with the setting parameters, wherein the watch further includes time display hands and means for rotating said hands, wherein the electronic appliance further includes a camera and optical recognition software that are controlled by the microcontroller of the electronic appliance, and wherein the method further comprises, following the setting step, on the order of the microcontroller of the watch, actuating the means for rotating the time display hands to place said hands in a position for coding an item of state data characteristic of a current setting of the watch, wherein the optical sensor of the watch is situated on a movement of the watch on a bottom side, the method further comprising, before the step of positioning the optical sensor of the watch facing the point light source of the electronic appliance:

removing a bottom of the watch casing to expose the optical sensor of the watch.

8. A method for setting a quartz watch using a portable electronic appliance, the watch including an optical sensor situated on a movement of the watch on a bottom side, a first microcontroller configured to receive electrical signals generated by the optical sensor, a point light source controlled by the first microcontroller of the watch, and time display hands, the portable electronic appliance including a point light source, a second microcontroller configured to control said point light source, and an optical sensor designed to supply electrical signals to the second microcontroller, the method comprising:

flashing, using the second microcontroller, the point light source of the electronic appliance to form a sequence of light pulses corresponding to a coding of setting parameters, the sequence then being received by the optical sensor of the watch facing the point light source of the portable electronic appliance;

decoding the received sequence of light pulses, by way of the first microcontroller, in order to recover the setting parameters;

setting, on the order of the microcontroller of the watch, the watch according to the setting parameters;

flashing, on the order of the first microcontroller, the point light source of the watch to form a sequence of light pulses corresponding to a coding of state data characteristic of a current setting of the watch, the sequence of light pulses being received by the optical sensor of the electronic appliance facing the point light source of the watch;

decoding the received sequence of light pulses, by way of the second microcontroller of the electronic appliance, in order to recover the state data; and comparing the state data with the setting parameters, wherein the method further comprises, following the setting and on the order of the first microcontroller, rotating the time display hands to place the hands in a position for coding an item of state data characteristic of the current setting of the watch having a bottom of a watch casing removed to expose the optical sensor of the watch.

* * * * *